US011519181B2

(12) United States Patent
Hilliaho

(10) Patent No.: US 11,519,181 B2
(45) Date of Patent: Dec. 6, 2022

(54) LOCKING ARRANGEMENT FOR FASTENING AN EDGE STRIP TO A PANEL

(71) Applicant: LUMON INVEST OY, Kouvola (FI)

(72) Inventor: Esa Hilliaho, Valkeala (FI)

(73) Assignee: LUMON INVEST OY, Kouvola (FI)

( * ) Notice: Subject to any disclaimer, the term of this patent is extended or adjusted under 35 U.S.C. 154(b) by 0 days.

(21) Appl. No.: 17/170,783

(22) Filed: Feb. 8, 2021

(65) Prior Publication Data

US 2021/0246664 A1 Aug. 12, 2021

(30) Foreign Application Priority Data

Feb. 6, 2020 (FI) ..... 20205124

(51) Int. Cl.
*E04C 3/00* (2006.01)
*E04F 13/08* (2006.01)
*E06B 3/54* (2006.01)

(52) U.S. Cl.
CPC ..... *E04F 13/0889* (2013.01); *E04F 13/0805* (2013.01); *E04F 2201/0523* (2013.01); *E06B 3/5436* (2013.01)

(58) Field of Classification Search
CPC ..... E04F 2201/0523; E04F 13/0805
USPC ..... 52/578
See application file for complete search history.

(56) References Cited

U.S. PATENT DOCUMENTS 4,703,598 A * 11/1987 Wilson ..... E04B 2/7409 52/204.591
5,373,672 A * 12/1994 Schulz ..... E06B 3/5427 52/235
6,708,458 B1 * 3/2004 Berger, Jr. ..... E06B 3/5892 52/775
6,817,144 B1 * 11/2004 Tavivian ..... A47K 3/30 52/717.03
8,863,440 B1 10/2014 Champlin
10,829,983 B2 * 11/2020 Haba ..... E06B 3/5892
(Continued)

FOREIGN PATENT DOCUMENTS

EP 1892362 A1 2/2008
EP 2119864 A2 11/2009
(Continued)

OTHER PUBLICATIONS

Aug. 7, 2020 Office Action issued in Finland Patent Application 20205124.

(Continued)

*Primary Examiner* — Basil S Katcheves
(74) *Attorney, Agent, or Firm* — Oliff PLC

(57) ABSTRACT

A locking arrangement, including a panel with a locking groove; an edge strip with a first form; as well as a locking element placed at least partly or entirely between the edge strip and the panel. The locking element includes a protrusion inserted in the locking groove of the panel and configured to prevent the panel from detaching from the edge strip, and a second form matching with and received by the first form of the edge strip, and configured to prevent the locking element from detaching from the edge strip. In the presented method for assembling the locking arrangement, in its first step, the locking element is placed against the panel so that the protrusion is inserted in the locking groove of the panel, after which they are installed in the edge strip.

19 Claims, 6 Drawing Sheets

(56) References Cited

U.S. PATENT DOCUMENTS

| | | | | |
|---|---|---|---|---|
| 2002/0195595 | A1* | 12/2002 | Shepherd | E04F 11/1853 256/25 |
| 2003/0000164 | A1* | 1/2003 | Berger, Jr. | E06B 3/5892 52/208 |
| 2012/0189378 | A1* | 7/2012 | Visa | E04F 11/1853 403/267 |
| 2015/0007514 | A1 | 1/2015 | Lathief | |
| 2017/0247937 | A1 | 8/2017 | Haba et al. | |
| 2018/0238102 | A1* | 8/2018 | Kornish | E06B 3/485 |

FOREIGN PATENT DOCUMENTS

| | | | |
|---|---|---|---|
| EP | 2479371 | A2 | 7/2012 |
| EP | 2677109 | A1 | 12/2013 |
| EP | 3138984 | A1 | 3/2017 |
| EP | 3456907 | A1 | 3/2019 |
| FI | 122930 | B | 8/2012 |
| GB | 2555474 | A | 5/2018 |
| WO | 2007/065972 | A1 | 6/2007 |
| WO | 2014/068178 | A1 | 5/2014 |

OTHER PUBLICATIONS

Jul. 1, 2021 Extended Search Report issued in European Patent Application No. 21150524.3.

* cited by examiner

LOCKING ARRANGEMENT FOR FASTENING AN EDGE STRIP TO A PANEL

FIELD OF THE INVENTION

The presented solution relates to a locking arrangement. The locking arrangement can be used for locking a panel to an edge strip. The locking arrangement can be applied in a panel system.

The solution presented also relates to a method for assembling the locking arrangement.

BACKGROUND OF THE INVENTION

Different types of panel systems may be incorporated in buildings, for example, in conjunction with the balcony or terrace of a building. In many cases, a glass panel is made of tempered glass and may comprise several laminated glass layers. A glass panel system typically comprises several glass panels which are preferably placed one after another and which in the closed position constitute a wall.

A panel system typically comprises an upper guide track and a lower guide track for guiding the travelling of the glass panel, one or more hinge elements and/or guide elements being placed within or on top of the guide tracks and fixed to the panel. The hinge element and/or control element controls the travelling of the panel, or the panel is suspended on the upper guide track by means of them, or the panel rests through them on the lower guide track which supports the panel. Typically, the panel may be movable along the upper and lower guide tracks by means of the said hinge element or guide element. Moving typically takes place manually by pushing.

The upper and lower guide tracks are normally installed in the horizontal position and fixed, for example, to structures of a building. The lower guide track may be positioned on floor level or higher, for example, on a railing structure. The panel is usually openable sideways and closable.

Two or more glass panels which are moved to a position in which they can be opened, may be placed next to each other in a bundle in the open position, whereby an open space is formed in the glass panel system, for example for ventilation or passage.

Some panel systems are disclosed in documents EP 1892362 A1, EP 3138984 A1 and WO 2014/068178 A1.

Some solutions for attaching an edge strip to the panel are disclosed in documents EP 2479371 A2 and EP 2119864 A2.

Some solutions for attaching accessory parts to the edge strip of the panel are disclosed in documents WO 2007/065972 A1 and EP 2677109 A1.

Applying the solution, the fastening of the edge strip to the panel should be as easy and reliable as possible. The solution should also allow a compact structure and, if necessary, the use of accessory parts.

BRIEF SUMMARY OF THE INVENTION

The presented solution is applicable in panel systems presented above. The panel system according to the solution can be installed in a building, for example in connection with a balcony, a terrace, a shelter, or a lean-to. The panel system can also be provided in connection with a terrace, a shelter or a lean-to separate from a building, for example to form wall structures for a roof construction. In an example, the system comprises a number of panels made of glass or a similar material which is particularly transparent.

The presented solution has the advantage of securing the engagement of a locking groove in a panel with a matching protrusion in a locking element. This is possible because the locking groove and the protrusion are placed against each other even before the locking element and the panel are installed in the edge strip. They are thus visible, unlike in solutions of prior art, in which, firstly, a corresponding panel with its locking groove has to be inserted in the edge strip provided with said protrusion.

Furthermore, the presented solution has the advantage of allowing the fastening of accessory parts, for example in a compact way or in the vicinity of the panel.

BRIEF DESCRIPTION OF THE DRAWINGS

The solution presented will be described in greater detail in the following, with reference to the accompanying drawings.

DETAILED DESCRIPTION OF VARIOUS EMBODIMENTS OF THE INVENTION

In the figures, the same or corresponding parts are marked with the same reference number.

Figure 1:
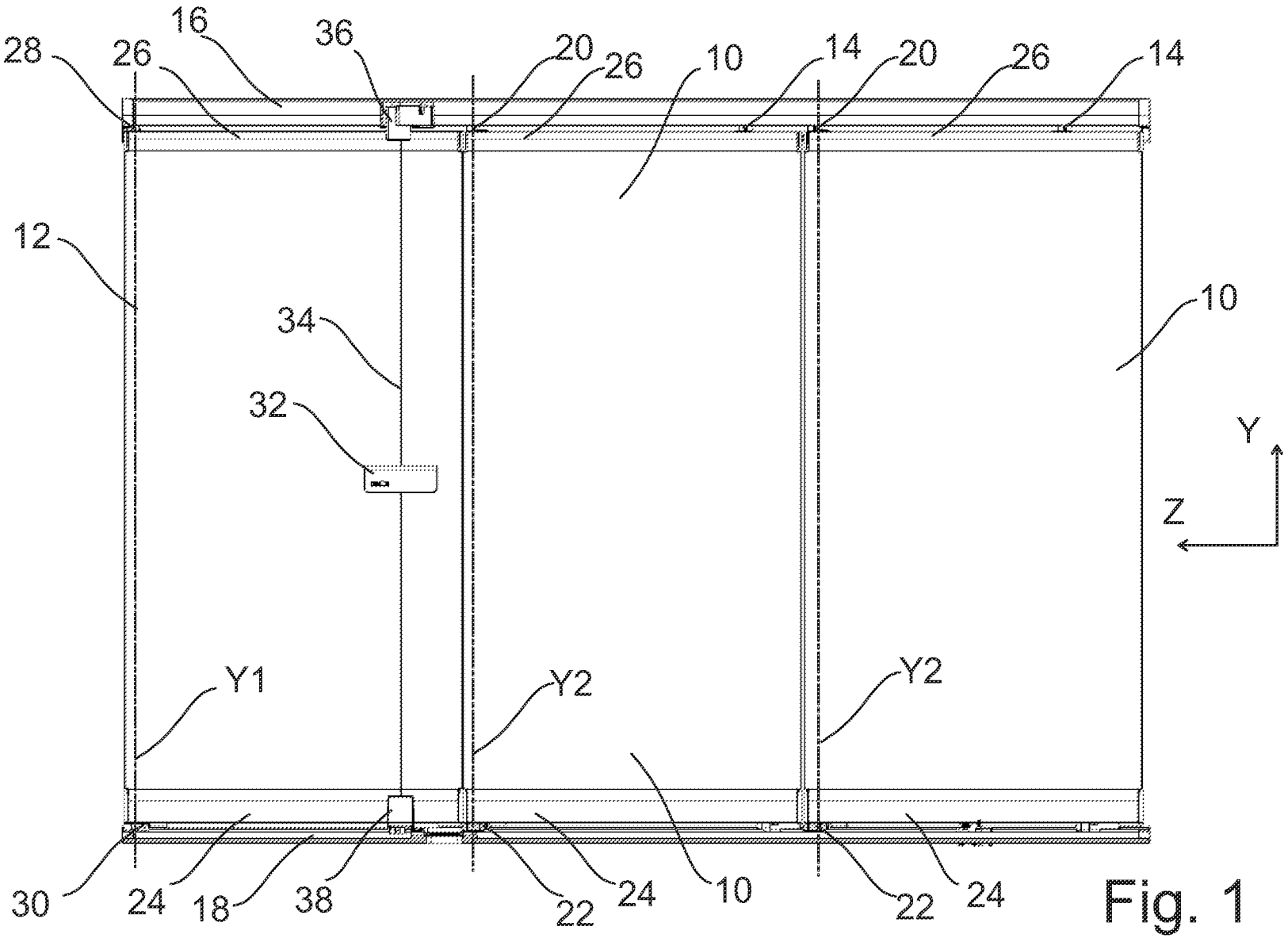
FIG. 1 shows a front view of a panel system in which the presented solution can be applied and in which all the panels are closed, parallel, and arranged one after the other.
Figures 2, 4, 5:
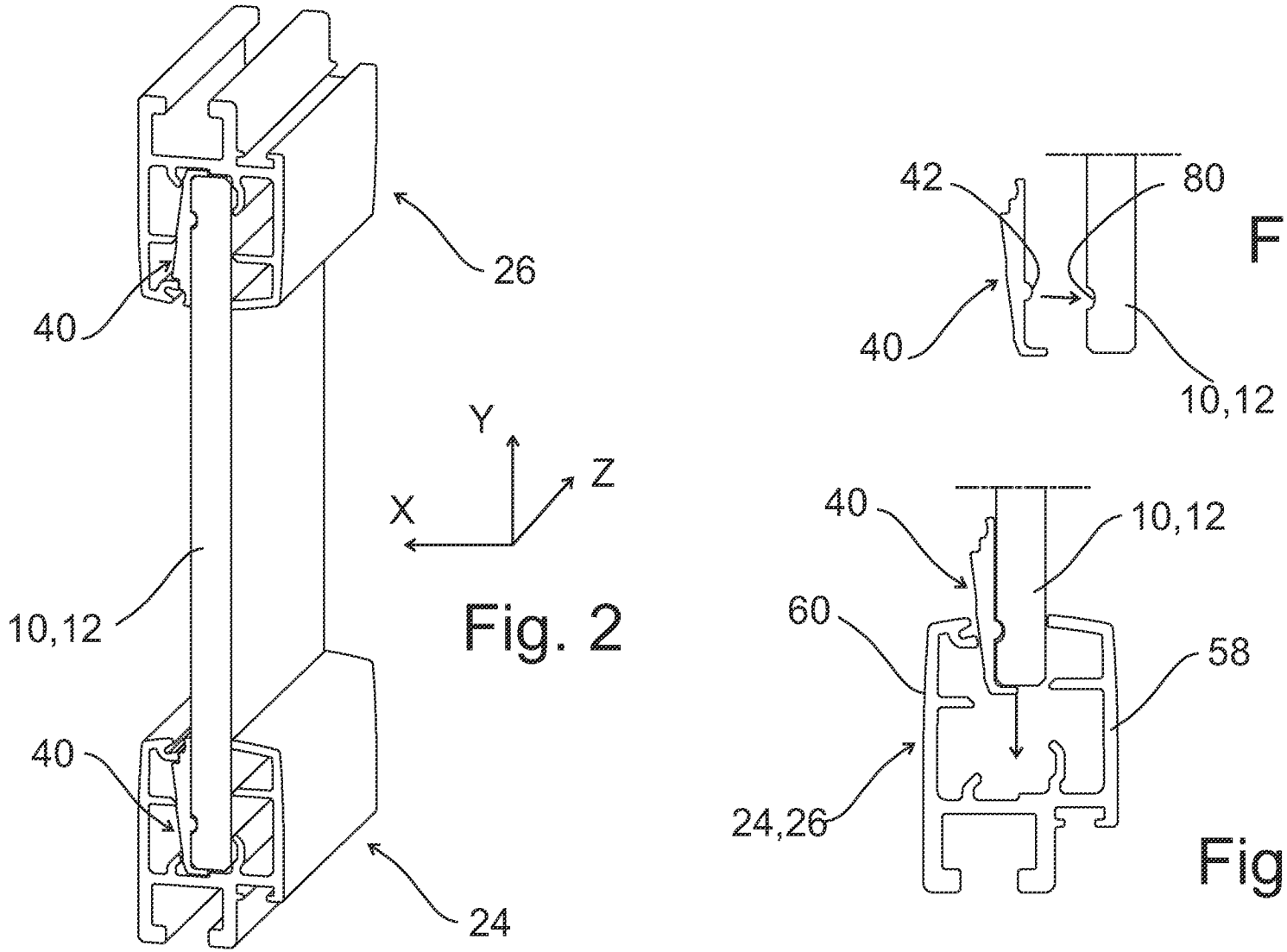
FIG. 2 shows a panel according to an example, in which the presented solution is applied.
FIG. 4 shows the first step of a method according to the presented solution.
FIG. 5 shows the second step of the method according to the presented solution.

In this description, a direction Z is defined, as well as directions X and Y, which are crosswise, preferably orthogonal to it as well as to each other. As shown in FIGS. 1 and 2, the directions Z and X can be horizontal, in which case the direction Y is vertical, oriented upwards.

FIG. 1 shows an example of a panel system to which the presented solution may be applied.

The panel system comprises one or more panels 10, 12. When closed, the panels are preferably parallel and positioned in succession in such a way that they form a wall or window or an access opening.

The panel system comprises a lower profile 18 and an upper profile 16, which are parallel, spaced from each other and placed on top of each other in the direction Y. The panels 10, 12 are placed between the lower profile 18 and the upper profile 16 in such a way that the panels are parallel with the direction Y. The panels 10, 12 are engaged with the lower profile 18 and the upper profile 16. The two opposite upright edges of the panel 10, 12 are parallel with the direction Y, and the upper and lower edges of the panel are parallel with the direction Z.

The lower profile 18 is mounted to a railing or a suitable surface, or is embedded in it, for example in a floor. The upper profile 16 is mounted to, for example, a ceiling or another suitable structure.

In FIG. 1, the panels 10, 12 are shown in a closed position so that they are parallel with the lower and upper profiles 16, 18.

According to an example shown in FIG. 1, the panel 10, 12 is stationary or movable along the lower and upper profiles 16, 18. In addition, the panel 10, 12 may be openable so that it pivots about a rotation axis Y1, Y2. The rotation axis Y1, Y2 is perpendicular to the longitudinal directions of the lower and upper profiles 16, 18 which join the direction Z. Said rotation axis Y1 (see panel 12), Y2 (see panel 10) is also located close to one vertical edge of the panel 10, 12.

The upper and lower edges of the panel 10, 12 may be provided with elements, such as a hinge element 20, 22, 28, and 30 or a guide element 14, which are placed within the upper profile 16 or the lower profile 18 and allow the panel 10, 12 to be opened and/or moved.

The upper edge of the panel 10, 12 may be provided with an edge strip 26, to which said elements are fastened and by means of which the panel 10, 12 can be engaged with the upper profile 16. Furthermore, the lower edge of the panel 10, 12 may be provided with an edge strip 24, to which said elements are fastened and by means of which the panel 10, 12 can be engaged with the lower profile 18.

According to an example shown in FIG. 1, the panel 10, 12 may be provided with elements, such as a locking element 36, a wire 34, a chain, a thread, or the like, or a handle element 32, by means of which the panel 10, 12 can be released or locked.

In the description below, reference numeral 10 will refer to either one of said panels 10 and 12. Correspondingly, in the description below, reference numeral 24 will refer to either one of said edge strips 24 and 26.

FIG. 2 shows an example of a panel 10 which is equipped with an edge strip and to which the solution presented may be applied.

When the panel 10 is provided with edge strips 24 at the upper and lower edges, said panel 10 can be applied in a panel system according to FIG. 1.

In another example, the panel 10 only comprises one edge strip, for example the edge strip 24 at the upper edge of the panel. Said panel can thus be utilized in a panel system which only comprises the above-described upper profile 16, to which the panel 10 is connected and along which the panel 10 is movable. In such a case, the panel 10 is, for example, not openable in the above-described way.

Figure 3:
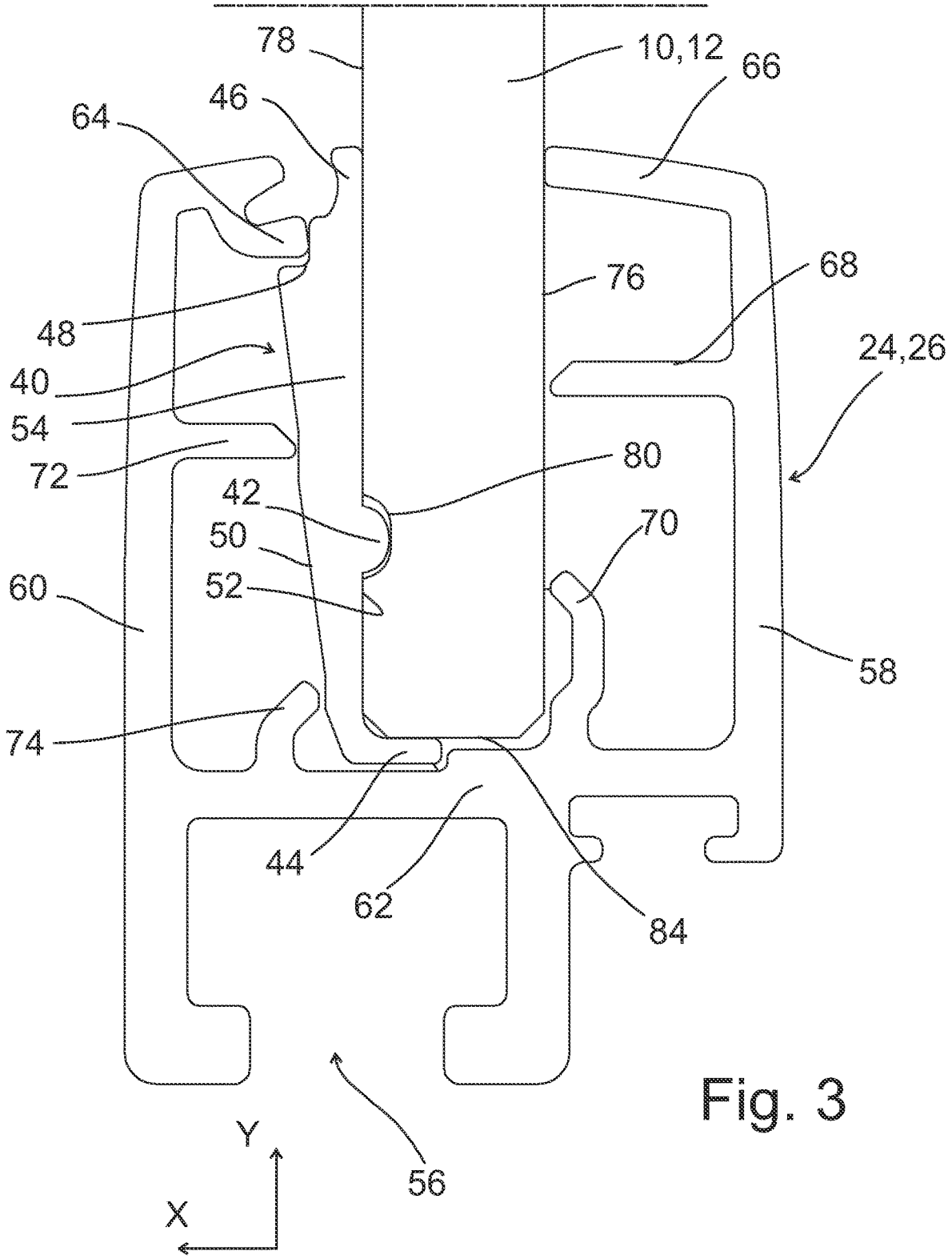
FIG. 3 shows a locking arrangement according to an example of the presented solution, viewed from the end of the edge strip.

FIG. 3 shows a locking arrangement according to the presented solution. Said solution can be applied in the panel 10 of FIGS. 1 and 2 as well as in the above-presented panel 10 with only one edge strip 24 at the upper or lower edge of the panel.

The locking arrangement according to the presented solution comprises a panel 10 equipped with a locking groove 80, and an edge strip 24 as well as a locking element 40.

According to an example shown in FIG. 3, the panel 10 comprises two parallel side faces 76, 78 delimited by a straight edge 84 of the panel. Normally, a total of four straight edges are provided, forming a rectangular railing panel 10. Preferably, the angle between each side face 76, 78 and the straight edge 84 is bevelled.

The panel 10 comprises at least one locking groove 80 provided in one of the side faces 76, 78, for example in the side face 78, as shown in FIG. 3. The locking groove 80 is parallel with the above-mentioned straight edge 84. The locking groove 80 is spaced form the straight edge 84 and preferably extends across the entire side face 78 to its both edges. The locking groove 80 may be U-shaped. The side face 76 on the opposite side of the panel 10 is preferably even.

Using the locking groove 80, it is simpler to install and lock the panel 10 to the edge strip 24.

According to an example shown in FIG. 3, the edge strip 24 comprises an open groove which faces upwards when the edge strip 24 is in the use position and fastened to the lower edge of the panel 10. Said groove faces downwards when the edge strip 24 is in its use position and fastened to the upper edge of the panel 10. The edge of the panel 10 is inserted in said open groove. The edge strip 24 and its longitudinal direction are parallel with the direction Z.

For fastening e.g. hinge elements 20, 22, 28, 30 and/or guide elements 14, the edge strip 16 may comprise a groove 56 which is open in an opposite direction with respect to said open groove for the panel 10.

Figure 10:
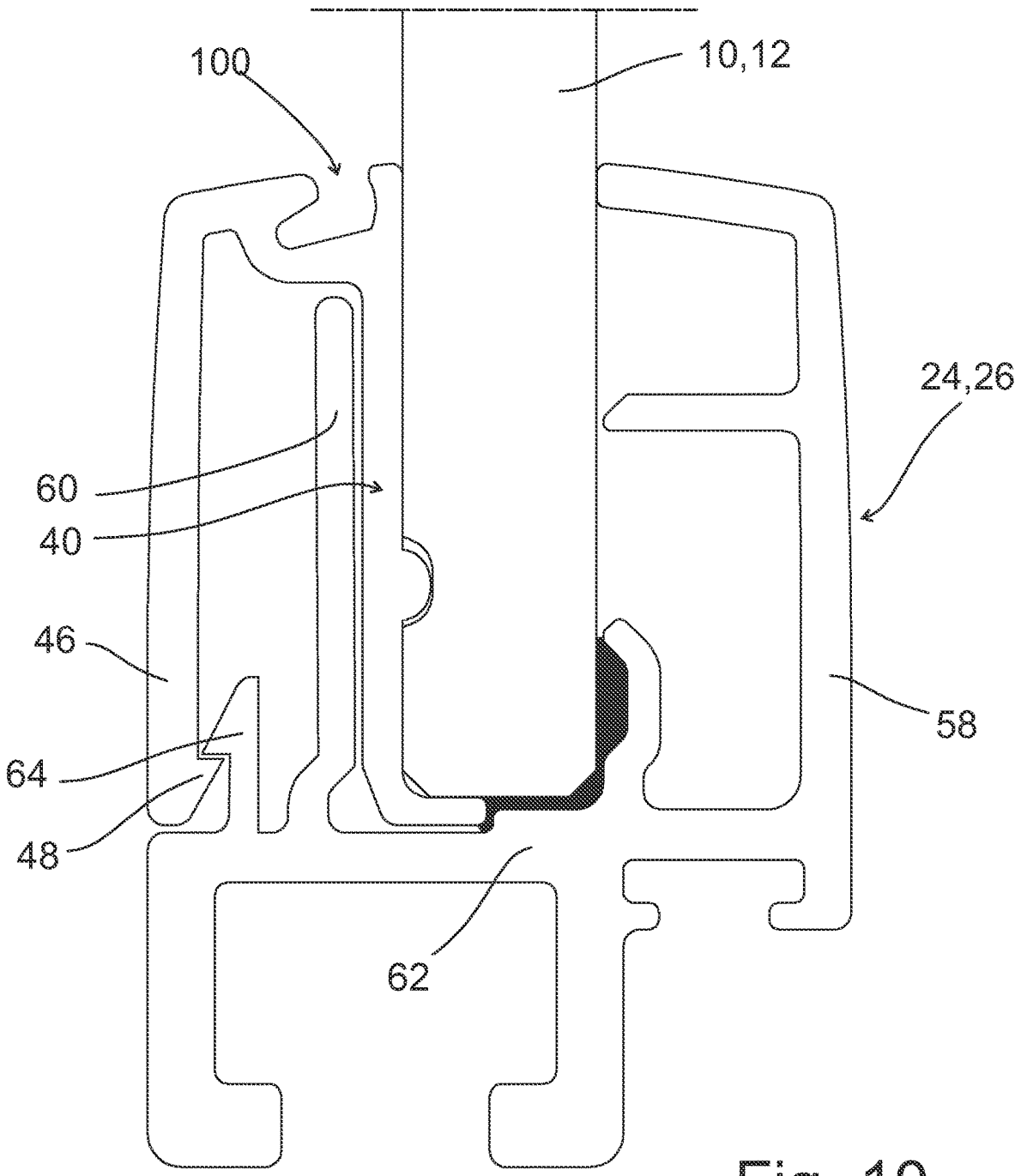
FIG. 10 shows a fastening arrangement according to a fifth example.

According to an example shown in FIG. 3, the edge strip 24 comprises at least two opposite side walls 58, 60 and a bottom wall 62 which delimit and constitute said open groove in which the locking element 40 and the panel 10 can be installed. According to an example, as shown in FIGS. 3 and 10, the side walls 58, 60 and the bottom wall 62 are seamless, integral parts of the edge strip 24. Each side wall 58, 60 is placed on one side of the panel 10 and may consist of several parts which are, for example, fastened to the bottom wall 62. Simultaneously, each side wall 58, 60 constitutes, for example, part of the outer face of the edge strip 24, in combination with the locking element 40, if necessary.

Said open groove may resemble, for example, the shape of a U. The side wall 58, 60 or the bottom wall 62 may comprise forms 64, 66, 68, 70, 72, 74 which are, for example, protrusions or grooves. Said protrusions or grooves may delimit a space which forms said U shape. Said protrusions or grooves may be placed against the locking element 40 or the panel 10, for example against the side face 76 of the panel 10 or the side face 50 of the locking element 40, and fix the position of the locking element 40 and the panel 10.

Preferably, the locking groove 80 of the installed panel 10 is inserted in said open groove.

According to an example shown in FIG. 3, the locking element 40 is a separate, stand-alone component which is inserted in the open groove of the edge strip 24, adjacent to the panel 10. In the direction X, the locking element 40 is between one side wall 60 of the edge strip 24 and the panel 10, 12. At least part of the locking element 40 or its length, or all of it, is placed in said space.

According to an example shown in FIG. 3, the locking element 40 comprises a body 54 with a first end 44 and an opposite second end 46. The body 54 comprises two side faces 50 and 52, of which the first side face 52 is placed against one side face 78 of the panel, and the other side face 50 is placed against one side wall 60 of the edge strip 24, 26, as shown in FIG. 3.

The first end 44 extends towards the bottom wall 62, and in an example it may also extend between the bottom wall 62 and the panel 10 in the transverse direction so that it is between the bottom wall 62 and the straight edge 84 of the panel 10, seen in the direction Y. The first end 44 may thus be placed against the straight edge 84. Consequently, the panel 10 can be used to push the locking element 40 and the end 44 into the edge strip 24 when the panel 10 is being installed.

According to an example shown in FIG. 3, the body 54 and the end 44 together constitute the shape of an L.

According to an example shown in FIG. 3, the second end 46 extends towards the opening formed by the open groove of the edge strip 24, wherein the end 46 can be fitted between the side wall 60 of the edge strip 24, 26 and the side face 78 of the panel 10, 12. In this way, the body 54 and the end 44 together form, for example, the shape of an I.

According to an example and FIG. 10, the locking element 40 may also extend beyond said opening, extending e.g. sideways or away from the side face 78 and, if necessary, also towards the bottom wall 62. Thus, the body 54 and the end 44 together form the shape of, for example, an L, a J, or a U.

According to FIG. 3, one side face 52 of the locking element 40 is provided with a protrusion 42 which is fitted in the locking groove 80 when the panel 10 is installed in the edge strip 24. The protrusion 42 is inside said open groove when the locking element 40 is fitted in said open groove.

The protrusion 42 is a bulge, a step, a stop, a tooth, or a cog on the side face 52 which—when fitted in the locking groove 80—has the function of preventing the detachment of the panel 10 from the edge strip 24 when it is subjected to forces. In particular, the purpose is to prevent the movement of the panel 10 in the direction Y, away and apart from the edge strip 24. It is necessary for the locking element 40 to remain in place in the edge strip 24.

For the panel 10 and the locking element 40 to be insertable together and simultaneously in the edge strip 24, the width of the open groove of the edge strip 24 has to be designed wider than the panel 10, particularly in the direction X. During the insertion, the panel 10 moves in a direction opposite to the direction Y.

Said width also accommodates for the insertability of the panel 10 in the edge strip 24 in such a way that the panel 10 and the locking element 40 are together and abutting each other so that the protrusion 42 is fitted in the locking groove 80. Said width is also adjusted to prevent or delimit the movement of the panel 10 and the locking element 40 in the direction X when they are fitted in the edge strip 24. In particular, said width is adjusted to prevent the locking element 40 from withdrawing in the direction X so far from the panel 10 that the protrusion 42 would come off the locking groove 80.

After this, the above-described function of the locking groove 80 to prevent the detachment of the panel 10 is possible. However, it is also required that the locking element 40 is simultaneously locked within the edge strip 24 and its movement in the direction Y, away and apart from the edge strip 24, is prevented.

According to examples shown in FIGS. 3 and 10, for said locking of the locking element 40, a form 64 is provided in the side wall 60 or the bottom wall 62. The form 64 is a protrusion, for example a bulge, a step, a stop, a tooth, or a cog, or alternatively a groove, which may be U-shaped, in the side or bottom wall 60, 62. The form 64 is, for example, provided at the opening constituted by the open groove of the edge strip 24, as shown in FIG. 3. Preferably, the form 64 is a seamless, integral part of the side or bottom wall 60, 62.

Furthermore, the locking element 40, for example its side face 50, is provided with a form 48 against which the form 64 is fitted when the locking element 40 and the panel 10 are installed in the edge strip 24. The form 48 is a protrusion in the locking element 40, for example a bulge, a step, a stop, a tooth, or a cog, or alternatively a groove which may be U-shaped. Preferably, the form 48 is a seamless, integral part of the locking element 40.

When placed against the matching form 48, the form 64 has the function of preventing the simultaneous detachment of the locking element 40 and the panel 10 from the edge strip 24 when it is subjected to forces. In particular, the purpose is to prevent the locking element 40 from moving in the direction Y, away and apart from the edge strip 24.

The forms 48 and 64 can be selected more specifically by, for example, experimenting so that they do not come apart or do not force the side or bottom wall 60, 62 to bend and cause detachment of the locking element 40 when subjected to minor or ordinary forces encountered under normal conditions of use.

According to an example of the solution shown in FIG. 3, the locking element 40 is at least partly wedge-shaped so that its cross section in the direction X tapers when viewed in a direction towards the bottom wall 62, opposite to the direction Y. The side faces 50 and 52 are thus inclined with respect to each other. The wedge-shaped structure facilitates the insertion of the locking element 40 together with the panel 10, 12 into the edge strip 24, 26. For example in the situation of FIG. 3, the inclined side face 50 will thus slide along the form 64 and simultaneously force the side wall 60 to give way until the form 48 is engaged with the form 64 and the side wall 60 can re-assume its position.

According to an example of the presented solution, the straight edge 84 of the panel 10 is fastened to the bottom wall 62 of the edge strip 24 by means of an adhesive. The function of the adhesive is to prevent the movement of the panel 10 in the direction Z along the edge strip 24 and its bottom wall 62 when these are subjected to forces.

The method according to the presented solution for fastening the edge strip 24 to the panel 10 is implemented as follows. Said method applies the locking arrangement according to the above-presented solution for fastening the edge strip 24 to the panel 10.

In the first step of the method, as shown in the example of FIG. 4, the locking element 40 is placed against the panel 10 so that the protrusion 42 of the locking element 40 is received in the locking groove 80 of the panel 10. This is done, for example, by placing the side face 52 against the side wall 78 and, if necessary, by placing the first end 44 against the straight edge 84.

In the next, second step, as shown in the example of FIG. 5, the locking element 40 and the panel 10 are together inserted in the edge strip 24, in its open groove, for example by a movement opposite to the direction Y. The locking element 40 is thus placed between the panel 10 and one side wall 60 of the edge strip 24.

In the next, third step, the locking element 40 and the panel 10 are together plunged into the open groove so that the form 48 of the locking element 40 is received by the form 64 of the edge strip 24.

In an example, if the locking element 40 is wedge-shaped as presented above, the inclined side face 50 is placed against the side wall 60, for example against the form 64, in said second step. Thus, in the third step of the method, the inclined side face 50 is slid along the side wall 60 or the form 64, simultaneously forcing the side wall 60 to give way in the direction X until the form 48 is received by the form 64 and the side wall 60 can re-assume its position.

After the presented third step, the locking element 40 and the panel 10 are placed in the edge strip 24, as shown in FIG. 3 or 10. The above description of the locking arrangement according to the presented solution applies to the examples of these FIGS. 3 and 10, and their function.

In an example, before or after the first step, an adhesive is applied onto the bottom wall 62 of the edge strip 24, to which the straight edge 84 of the panel 10 will adhere in the third step.

According to an example shown in FIG. 3, at the opening formed by the open groove of the edge strip 24, the locking element is placed between the side wall 60 of the edge strip 24 and the side face 78 of the panel 10. At said opening, the side wall 60 extends towards the side face 78. According to another example shown in FIG. 10, at the opening formed by the open groove of the edge strip 24, the locking element 40 extends away from the side face 78.

In an example, the side wall 60 or the locking element 40, or their combination, constitutes an upper surface at said opening, next to the panel 10, 12, the upper surface being transverse to the side face 78 of the panel. Correspondingly, the side wall 58 may constitute an upper surface at said opening, next to the panel 10, the upper surface being transverse to the side face 76 of the panel. The section of the side wall 58, 60 or of the locking element 40, left between said upper surface and the bottom wall 62, may be substantially parallel with the side faces 76, 78.

Figure 6:
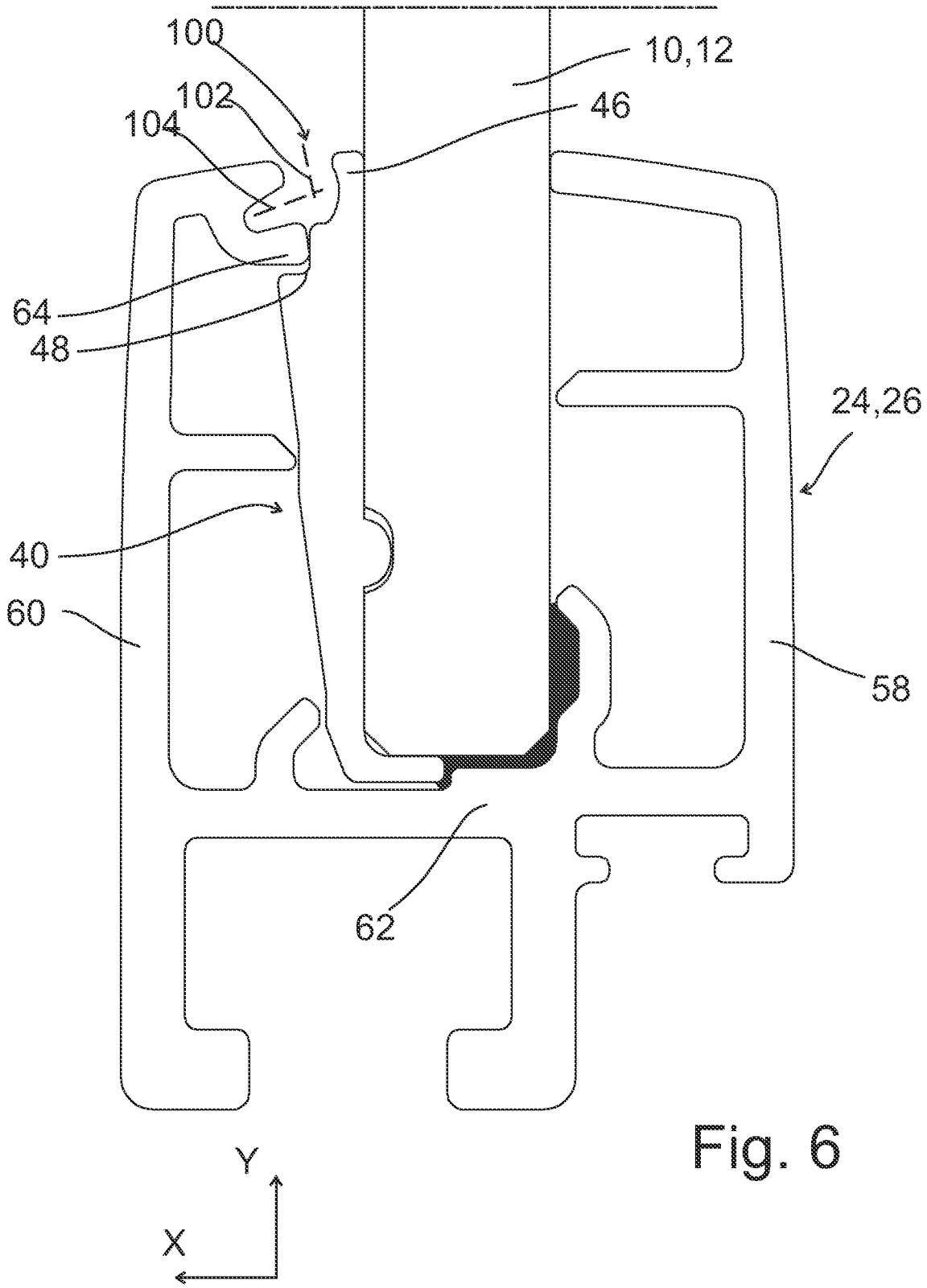
FIG. 6 shows a fastening arrangement according to an example, viewed from the end of the edge strip.

FIG. 6 shows an edge strip 24 equipped with a fastening groove 100.

The fastening groove 100 makes it possible to fasten accessory parts, such as a sunshade screen, to the edge strip 24. For example, a means for fastening the sunshade screen can be placed in said fastening groove 100.

Said fastening groove 100 can be applied in the panel 10 of FIGS. 1 and 2 as well as in the above presented panel 10 with only one edge strip 24 at the upper or lower edge of the panel. Said fastening groove 100 can also be applied in the above presented arrangement, shown e.g. in FIG. 3 or in FIG. 10, for fastening the edge strip 24 to the panel 10.

In another example, the fastening groove 100 is applied in the edge strip 24 to which the panel 10 is fastened. In a third example, said panel 10 is also equipped with a locking groove 80, as presented above. In a fourth example, said edge strip 24 is further equipped with a locking element 40, as presented above.

We shall discuss these examples jointly in the following.

According to an example shown in FIG. 6, the fastening groove 100 is provided next to the side wall 60, adjacent to its outer face, for example next to the upper surface formed by said side wall 60.

Figure 7:
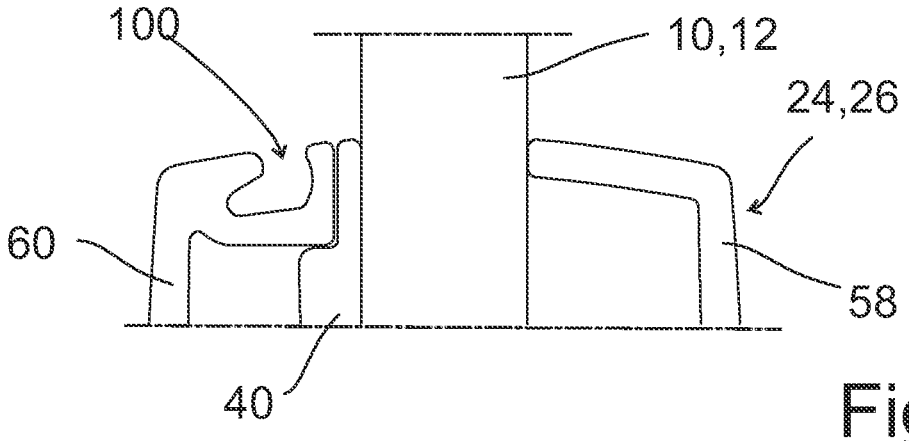
FIG. 7 shows a fastening arrangement according to another example.

According to an example shown in FIG. 7, the fastening groove 100 is provided in the side wall 60, on its outer face, for example on the upper face of the side wall 60. According to another example shown in FIG. 8 or FIG. 9, the fastening groove 100 is provided in the side wall 58, on its outer face, for example on the upper surface formed by the side wall 58.

According to an example shown in FIG. 10, the fastening groove 100 is provided in the locking element 40, on its outer face, for example on the upper surface formed by the locking element 40. This makes it possible to use fastening grooves of various types or different positions, because the locking element can be replaced with a different one.

The fastening groove 100 extends continuously in the longitudinal direction of the edge strip 24, in the direction Z, forming a groove-shaped structure.

The fastening groove 100 is accessible from the outside of the panel 10, for example from the direction Y in the use position of FIG. 6, or from a direction opposite to the direction Y, depending on whether the edge strip 24 is installed in the lower edge of the panel 10, as shown in FIG. 3, or in the upper edge of the panel 10, as shown in FIG. 2.

In an example, the fastening groove 100, namely its first section 102, first extends from the outer face of the edge strip 24 towards its inner part, and the first section 102 is followed by a second section 104, after which the fastening groove bends or curves in a direction transverse to the section 102. In an example, the first section 102 extends towards the panel 10, and the second section 104 extends towards the bottom wall 62. In an example shown in FIGS. 6 and 10, the first section 102 extends towards the bottom wall 62, and the second section 104 extends away from the panel 10.

In an example shown in FIGS. 6 and 10, the first section 102 extends from the above-mentioned upper surface towards the bottom wall 62, and the second section 104 extends away from the panel 10 which is installed in the edge strip 24, for example in the direction X. The second section 104 extends, within the side wall 60 or the locking element 40, away from the side face 78, in a direction transverse to it. The second section 104, when in the side wall 58, extends, within the side wall 58, away from the side face 76, in a direction transverse to it.

In an example, the fastening groove 100 is L-shaped, J-shaped or curved, whereby a compact structure is achieved.

In an example, the second section 104 is designed so that part of the side wall 58, 60 will be left between the outer surface or said upper surface and the second section 104. Said part of the side wall 58, 60 constitutes a cover or a protrusion extending above the second section 104, as shown in FIGS. 6 to 10. Said fastening member can be supported below said cover or protrusion.

The above-mentioned outer face or upper surface of the side wall 58, 60 is provided with an opening of the first section 102, via which the fastening groove 100 is accessible.

Figure 8:
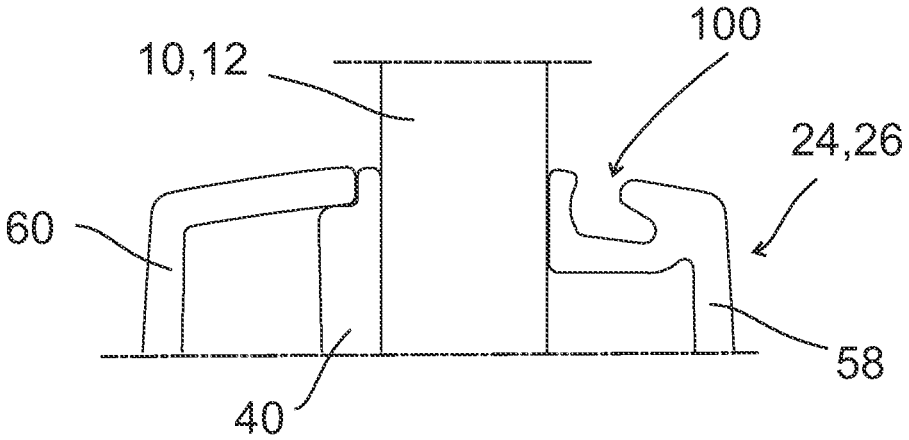
FIG. 8 shows a fastening arrangement according to a third example.
Figure 9:
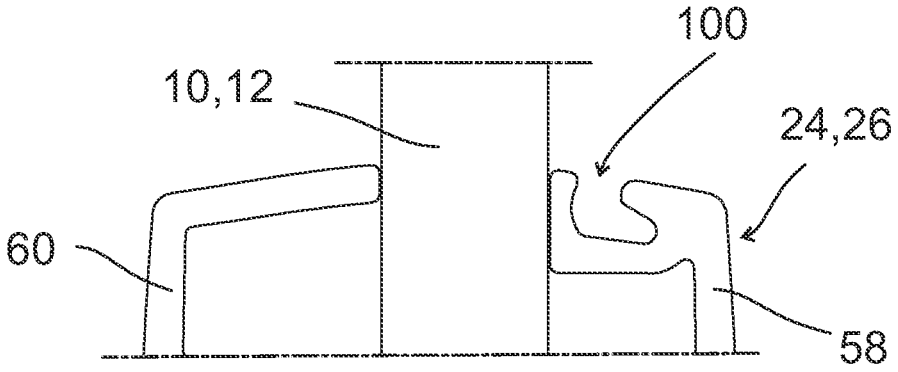
FIG. 9 shows a fastening arrangement according to a fourth example.

According to the first alternative, the outer or upper surface of the side wall 58, 60 delimits the fastening groove 100 and its opening, at its both edges, as shown in FIGS. 7, 8 and 9.

In the above-presented examples applying the fastening groove 100, an alternative panel may be used, which corresponds to the above-presented panel 10 and its different examples in other respects but does not have a locking groove 80, whereby the side face 78 is, for example, even. Alternatively, a corresponding locking groove is provided in the side face 76. Thus, the side wall 58 may comprise a form, for example a form 66, 68, 70, which is for example a protrusion. Said form is inserted in the locking groove of the panel 10 and prevents the panel 10 from coming off the edge strip 24.

Furthermore, in the above-presented examples applying the fastening groove 100, an alternative locking element may be used, which corresponds to the above-presented locking element 40 and its various examples in other respects but does not have a protrusion 42, whereby the side face 52 is, for example, even. Said locking element is used, for example, for forcing the panel 10 against the above-presented form.

Furthermore, in the above-presented examples applying the fastening groove 100, an alternative edge strip may be used, which corresponds to the above-presented edge strip 24 and its various examples in other respects but does not apply the above-presented locking element 40. One example is shown in FIG. 9. In this case, the panel 10 is installed in the open groove of the edge strip 24 without a locking element 40. Thus, the forms of the side walls 58, 60 can also be placed against the side face 78. The above-described locking groove may be applied.

In the above-presented first alternative, the locking element 40 is separate from the locking groove 100, as shown in the example of FIG. 7 or 8, when the locking element 40 is also applied in the solution.

According to another alternative, the locking groove 100 is between the side wall 60 and the locking element 40, as shown in the example of FIG. 6. In this second alternative, for example the side wall 60, for example its outer or upper surface, delimits the fastening groove 100 and its opening, at its one edge, and the above-presented locking element 40 delimits the fastening groove 100 and its opening at its opposite, second edge.

In an example, the form 64 of the edge strip 24 delimits the fastening groove 100 or constitutes the bottom of the fastening groove 100, at least in part. Furthermore, in an example, the end 46 of the locking element 40 may delimit the fastening groove 100 and be placed between the fastening groove 100 and the panel 10.

Considering the above-presented fastening groove 100 a solution of its own, that is, a fastening arrangement for accessory parts, the fastening arrangement comprises, first of all, the edge strip 24 with opposite side walls 58, 60 and a bottom wall 62, forming an open groove, in which the straight edge 84 of the panel 10 can be installed. Secondly, it comprises the fastening groove 100 for accessory parts, the fastening groove 100 being provided in the side wall 58 or 60, for example in said upper surface.

In one alternative, the fastening arrangement according to this solution further comprises a locking element 40 inserted in the open groove of the edge strip 24, the locking element 40 being placed between one side wall 60 of the edge strip 24 and the panel 10 to be installed. In this alternative, the fastening groove 100 may be provided between said side wall 60 and the locking element 40.

In one alternative, the fastening arrangement according to this solution further comprises a panel 10 with two parallel side faces 76 and 78 delimited by the straight edge 84 of the panel 10.

In this solution of the fastening arrangement, it is possible to apply the above described fastening grooves 100 and/or edge strips 24 and/or panels 10 and/or locking elements 40.

The upper profile 16 and/or the lower profile 18, or the edge strip 24, and/or the locking element 40 are, in an example, made of aluminium or an aluminium alloy, and have a continuous or elongated shape, the longitudinal direction being parallel with the direction Z. It is possible to use other materials and metals as well.

The hinge element 20, 22, 28 or 30, or the guide element 14 is preferably a piece made of plastic material, but other materials, such as metal, may also be used.

The panel 10 is made of e.g. glass, according to one example, tempered glass. The panel made of glass may be a laminated structure. Other glass materials may be used as well. The panel 10 is preferably transparent, but opaque panels can also be used.

The solutions presented are not limited merely to the examples shown in the accompanying figures or specifically disclosed in the foregoing description, or to which reference has been made in the description. The different embodiments of the presented solution are disclosed in the accompanying claims.

What is claimed is:

1. A locking arrangement comprising:

a panel with two parallel side faces delimited by a straight edge of the panel, and a locking groove provided in one of the side faces and parallel with said straight edge and a first direction;

an edge strip having opposite side walls and a bottom wall which constitute an open groove, in which open groove the straight edge of the panel is installed, and a first protrusion or groove provided in one of the side walls; and a locking element inserted in the open groove of the edge strip, said locking element being placed at least partly or entirely between the panel and one of the side walls of the edge strip, wherein the locking element comprises:

a protrusion formed in one side face of the locking element and inserted in the locking groove of the panel, the protrusion being configured to prevent the panel from detaching from the edge strip and from moving in a second direction which is transverse to the first direction, and a second protrusion or groove provided in one side face of the locking element, matching with and placed against the first protrusion or groove of the edge strip, the second protrusion or groove being configured to prevent the locking element from detaching from the edge strip and from moving in the second direction.

2. The locking arrangement according to claim 1, wherein the width of the open groove of the edge strip in a third direction is configured to correspond to a joint width of the panel and the locking element in order to prevent or limit the panel and the locking element from moving in the third direction within the edge strip, to prevent the protrusion of the locking element from being detached from the locking groove of the panel, and wherein the third direction is transverse to both the first direction and the second direction.

3. The locking arrangement according to claim 1, wherein the straight edge of the panel is fastened to the bottom wall of the edge strip by means of an adhesive, to prevent the panel from moving in the first direction along the edge strip.

4. The locking arrangement according to claim 1, wherein the protrusion of the locking element is provided on an opposite side of the locking element with respect to the second protrusion or groove of the locking element.

5. The locking arrangement according to claim 1, wherein the locking element is at least partly or entirely wedge-shaped.

6. The locking arrangement according to claim 1, wherein the locking element comprises a body with a first end which first extends towards the bottom wall and then in a lateral direction between the bottom wall and the straight edge of the panel.

7. The locking arrangement according to claim 1, wherein the edge strip is provided with a fastening groove for accessory parts, the fastening groove being arranged between one of the side walls of the edge strip and the locking element.

8. The locking arrangement according to claim 7, wherein the one side wall of the edge strip constitutes an upper surface next to the panel, the upper surface being transverse to the side faces of the panel, and wherein the fastening groove is adjacent to said upper surface.

9. The locking arrangement according to claim 7, wherein the fastening groove comprises:

a first section extending from an outer face of the edge strip towards the interior of the edge strip, and a second section forming an extension to the first section and bending or curving in a transverse direction with respect to the first section.

10. The locking arrangement according to claim 9, wherein the first section extends towards the bottom wall of the edge strip and the second section extends away from the panel.

11. The locking arrangement according to claim 1, wherein one of the side walls of the edge strip constitutes an upper surface next to the panel, the upper surface being transverse to the side faces of the panel, and wherein said upper surface is provided with a fastening groove for accessory parts.

12. The locking arrangement according to claim 11, wherein the fastening groove comprises:

a first section extending from an outer face of the edge strip towards the interior of the edge strip, and a second section forming an extension to the first section and bending or curving in a transverse direction with respect to the first section.

13. The locking arrangement according to claim 12, wherein the first section extends towards the bottom wall of the edge strip and the second section extends away from the panel.

14. The locking arrangement according to claim 1, wherein the locking element constitutes an upper surface next to the panel, the upper surface being transverse to the side faces of the panel, and wherein said upper surface is provided with a fastening groove for accessory parts.

15. The locking arrangement according to claim 1, wherein one of the side walls of the edge strip and the locking element constitute an upper surface next to the panel, the upper surface being transverse to the side faces of the panel, and wherein said upper surface is provided with a fastening groove for accessory parts.

16. A panel system provided with a locking arrangement, comprising:

a panel with two parallel side faces delimited by a straight edge of the panel, and a locking groove provided in one of the side faces and parallel with said straight edge and a first direction;

an edge strip having two opposite side walls and a bottom wall which constitute an open groove, in which open groove the straight edge of the panel is installed, and a first protrusion or groove provided in one of the side walls;

a lower profile or an upper profile, or both the lower profile and the upper profile, to which the panel is connected;

a locking element inserted in the open groove of the edge strip, said locking element being placed at least partly or entirely between the panel and one of the side walls of the edge strip, wherein the locking element comprises:

a protrusion formed in one side face of the locking element and inserted in the locking groove of the panel, the protrusion being configured to prevent the panel from detaching from the edge strip and from moving in a second direction which is transverse to the first direction, and a second protrusion or groove provided in one side face of the locking element, matching with and placed against the first protrusion or groove of the edge strip, the second protrusion or groove being configured to prevent the locking element from detaching from the edge strip and from moving in the second direction.

17. A method for assembling a locking arrangement, the locking arrangement comprising:

a panel with two parallel side faces delimited by a straight edge of the panel, and a locking groove provided in one of the side faces and parallel with said straight edge and a first direction;

an edge strip having opposite side walls and a bottom wall which constitute an open groove, and a first form provided in one of the side walls; and a locking element, the locking element including a protrusion provided in one side face of the locking element and matching with the locking groove of the panel, and a second form provided in one side face of the locking element and matching with the first form of the edge strip;

wherein the method comprises:

in a first step, placing the locking element against the panel so that the protrusion of the locking element is inserted in the locking groove of the panel;

in a second step, inserting the locking element and the straight edge of the panel together in the open groove of the edge strip so that the locking element is at least partly or entirely placed between the panel and one of the side walls of the edge strip, and in a third step, plunging the locking element and the panel into the open groove so that the second form of the locking element is received by the first form of the edge strip, the second form being configured to prevent the locking element from being detached from the edge strip and the panel from moving in a second direction, wherein simultaneously the protrusion of the locking element is configured to prevent the panel from being detached from the edge strip and from moving in the second direction which is perpendicular to the first direction, wherein the second step includes inserting the locking element and the panel together in the open groove of the edge strip by a movement in a direction opposite to the second direction.

18. The method according to claim 17, wherein the locking element is at least partly or entirely wedge-shaped and comprises a first side face which is placed against one of the side faces of the panel, and an opposite, inclined second side face which is placed against one of the side walls of the edge strip, and wherein in the third step the method comprises:

sliding the second side face along the one side wall of the edge strip and simultaneously forcing the one side wall to give way until the second form of the locking element is received by the first form of the edge strip and simultaneously the one side wall resumes its position.

19. The method according to claim 17, wherein the first form of the edge strip is a protrusion or a groove, and the second form of the locking element is a protrusion or a groove matching with the first form of the edge strip.

* * * * *